US011408683B1

(12) United States Patent
Shaeri et al.

(10) Patent No.: US 11,408,683 B1
(45) Date of Patent: Aug. 9, 2022

(54) HEAT TRANSFER DEVICE HAVING AN ENCLOSURE AND A NON-PERMEABLE BARRIER INSIDE THE ENCLOSURE

(71) Applicant: ADVANCED COOLING TECHNOLOGIES, INC., Lancaster, PA (US)

(72) Inventors: Mohammad Reza Shaeri, Lancaster, PA (US); Richard W. Bonner, III, Lancaster, PA (US); Michael C. Ellis, Lancaster, PA (US); Elizabeth K. Seber, Lancaster, PA (US); Maksym V. Demydovych, Lancaster, PA (US)

(73) Assignee: Advanced Cooling Technologies, Inc., Lancaster, PA (US)

( * ) Notice: Subject to any disclaimer, the term of this patent is extended or adjusted under 35 U.S.C. 154(b) by 127 days.

(21) Appl. No.: 17/003,539

(22) Filed: Aug. 26, 2020

Related U.S. Application Data

(60) Provisional application No. 62/894,313, filed on Aug. 30, 2019.

(51) Int. Cl.
*F28D 15/02* (2006.01)
*F28D 15/04* (2006.01)

(52) U.S. Cl.
CPC ..... *F28D 15/0266* (2013.01); *F28D 15/025* (2013.01); *F28D 15/046* (2013.01)

(58) Field of Classification Search
CPC ... F28D 15/0266; F28D 15/025; F28D 15/046
USPC ..... 165/104.21, 104.26
See application file for complete search history.

(56) References Cited

U.S. PATENT DOCUMENTS

| | | | | |
|---|---|---|---|---|
| 4,602,679 | A * | 7/1986 | Edelstein | F24S 10/95 122/366 |
| 6,330,907 | B1 * | 12/2001 | Ogushi | F28D 15/043 165/907 |
| 6,948,556 | B1 | 9/2005 | Anderson et al. | |
| 6,990,816 | B1 | 1/2006 | Zuo et al. | |
| 7,188,662 | B2 * | 3/2007 | Brewer | H01L 23/473 257/E23.098 |
| 2003/0079865 | A1 * | 5/2003 | Son | H01L 23/427 165/135 |
| 2007/0101746 | A1 | 5/2007 | Schlom et al. | |
| 2016/0131438 | A1 * | 5/2016 | De Troz | F28D 15/043 29/890.032 |

(Continued)

*Primary Examiner* — Tho V Duong
(74) *Attorney, Agent, or Firm* — McNees Wallace & Nurick

(57) ABSTRACT

A heat transfer device includes a hollow spacer between opposed substrates, defining an enclosure, at least one of the substrates adapted to be secured to at least one heat source. A non-permeable barrier is in the enclosure between the substrates. A first chamber inside the enclosure is defined by the spacer, the substrates, and the barrier, the first chamber in fluid communication with at least one first inlet and first outlet. A second chamber inside the enclosure and outside the first chamber and is defined by the spacer, the substrates, and the barrier, the second chamber in fluid communication with at least one second outlet. A wick structure is secured to at least one substrate, a first portion of the wick structure in the first chamber, and a second portion of the wick structure in the second chamber and interconnecting in passive liquid communication with the first portion.

22 Claims, 7 Drawing Sheets

(56) References Cited

U.S. PATENT DOCUMENTS

2018/0031330 A1* 2/2018 Roberts ..... F28D 15/046

* cited by examiner

HEAT TRANSFER DEVICE HAVING AN ENCLOSURE AND A NON-PERMEABLE BARRIER INSIDE THE ENCLOSURE

STATEMENT REGARDING FEDERALLY SPONSORED RESEARCH

This invention was made with Government support under contract number DE-SC0018845 awarded by the Department of Energy. The Government has certain rights in the invention.

FIELD OF THE INVENTION

The present invention is directed to heat transfer devices for removing heat from heating devices having large heat fluxes. More particularly, the present invention is directed to compact heat transfer devices for removing heat from heating devices having large heat fluxes, wherein the devices utilize a hybrid two-phase cooling system.

BACKGROUND OF THE INVENTION

Rapid miniaturization of integrated circuits (ICs) used in electronic/power devices along with an increase in their power has resulted in large heat fluxes (exceeding 200 W/cm$^2$) that must be dissipated to avoid device failure. An efficient thermal management solution for such high heat flux devices must (i) be compact, (ii) remove a large amount of heat from the device, (iii) maintain the maximum temperature of the device below a design limit, (iv) minimize the temperature distributions across the device, and, for an active cooling system, (v) operate with a low pumping power for minimizing the external power required.

There is great interest in constructing high-electron mobility transistors (HEMTs) of gallium nitride (GaN) for high RF power applications, due to its excellent properties. GaN HEMTs have an order of magnitude greater power density compared to silicon and gallium arsenide transistors, which allows for a tenfold size reduction for the same output power while simultaneously saving material cost. However, despite demonstrated high power-density above 40 W/mm (power per mm of the gate width of the device), commercial GaN HEMTs operate at much lower power densities up to 7 W/mm. This is due to the self-heating effect, which leads to the formation of hotspots near the junction region of these devices and results in a significant reduction in the lifetime and reliability of the power devices. Therefore, effective thermal management of high radio frequency (RF) power systems using GaN HEMTs is crucial to ensure their high performance, reliability, and further commercialization.

FIG. 1 schematically illustrates a known heat transfer device 10 that is part of a cooling system for heat sources 12, such as an RF power system.

As shown in FIG. 1, heat transfer device 10 includes two substrates 14 that each includes four heat sources 12 such as transistors positioned in series of the RF power system. The power will switch in a fraction of a millisecond between substrates 14. As a result, the source of heat in the power system alternates quickly between upper and lower substrates 14. To handle this heat load, cooling is required that is located between substrates 14 that meet four key requirements: (i) removing heat fluxes between 200-300 W/cm$^2$ from individual heat sources 12, and a total heat of more than 120 W from each substrate 14, (ii) using dielectric materials between heat sources 12 of each substrate 14, as well as between the two substrates 14, in order to avoid conducting electricity between heat sources 12, (iii) having an inlet 16 and an outlet 18 at the same side of the heat transfer device, because the power system will be located inside a vacuum box with access from only one side, and (iv) being compact, which means the distance between the two substrates must be minimized.

However, the most commonly used cooling technologies (as summarized in Table 1) face limitations to meet requirements.

The shortcomings of the most commonly used cooling technologies are listed below and summarized in Table 1.

TABLE 1

Advantages and challenges of different cooling technologies to high performance cooling requirements.

| Technology | Advantages | Challenges |
|---|---|---|
| Air-cooled systems | Simplicity; Low cost | Cannot handle high heat fluxes |
| Diamond heat sink | Superb thermal conductivity | Large mechanical stress between diamond and GaN |
| Vapor chamber | Excellent heat spreader; Isothermal process | Cannot operate between alternating heat sources and heat sinks |
| Heat pipe | Transport heat over longer distances compared with vapor chamber; Isothermal process | Limited heat flux capability below 100 W/cm$^2$ over large areas |
| Microchannel liquid cooling | Large heat removal | Large pumping power; Large temperature rise |
| Microchannel two-phase cooling | Large heat removal; Isothermal process; Low pumping power | Flow instabilities that lead to dry-out/hot spots |

Air-cooled systems are not capable of removing a significant amount of heat due to poor thermal properties of air.

Integration of materials with superb thermal conductivity, such as diamond, as a heat spreader to the heat sources leads to material integration issues such as significant mechanical stress between the two materials.

Vapor chambers spread heat in a short distance between a fixed evaporator and condenser; therefore, this technology is not an appropriate cooling system in many applications due to the alternating heat load, which corresponds to the change in the location of the evaporator and condenser. In addition, if the condenser of the vapor chamber is not connected to a sufficiently cold ultimate heat sink, the cooling mechanism is insufficient.

Heat pipes have a limited heat flux capability, typically below 100 W/cm$^2$ over large surfaces.

Despite demonstrated high heat removal (exceeding 200 W/cm$^2$) by the microchannel single-phase liquid cooling technology, very large pumping powers resulting from high pressure drop through the microchannels and temperature gradients in the direction of flow due to relying on the sensible heat are also associated with this technology.

Despite significant heat removal capability, excellent temperature uniformity, and low pumping power, two-phase micro/minichannel heat sinks are prone to serious drawbacks of flow instabilities and flow regime oscillations resulting from transitions between different boiling regimes in different parallel channels. These limitations lead to dry-out/hot spots, and ultimately device failure.

A heat transfer device that shows one or more improvements in comparison to the prior art would be desirable in the art.

SUMMARY OF THE INVENTION

In one embodiment, a hybrid two-phase cooling technology includes a compact heat transfer device or cold plate to remove large amounts of heat from heat source(s). The heat removal process relies on evaporation from a wick in contact with the heat source(s). Evaporation allows the working fluid, through phase change, to carry away latent heat from the heat source in the form of vapor. This phenomenon is one of the most efficient passive two-phase cooling mechanisms and results in a low thermal resistance and excellent temperature uniformity across the heat source, such as an electronics/power device. Evaporator wicks can be fabricated as optimized structures with a combination of thick wicks (feeds) and monolayer wicks to further enhance the Critical Heat Flux (CHF) limit and reduce the thermal resistance, respectively. The wick is continuously supplied with liquid that is pumped into the heat transfer device, sometimes referred to as a cold plate, by a mechanically pumped two-phase cooling loop. The liquid or liquid working fluid is transported laterally through the wick structure, rather than flowing along the entire wick. This creates a region on one portion of the wick, such as the outer edge of the wick that accepts liquid, while another portion of the wick, such as the central portion of the wick is exposed only to vapor. This novel arrangement prevents evaporators from operating as flooded evaporators that increase the thermal resistance of the cold plate, due to an extra layer of liquid over the wick. Throughout the cooling process, vapor and liquid are separated from each other by a non-permeable barrier. Benefits of Applicant's invention include:

Transport Large Amounts of Heat Over Long Distances: The use of a pumped two-phase loop with relatively low pressure drop tubes to connect the cold plate to a condenser allows a large amount of heat to be transferred over a long distance.

Low Thermal Resistance: This is due to the innovative evaporator wick structure that includes low thermal resistance evaporation sections (monolayer evaporation zone).

High CHF: This is also due to the innovative evaporator wick structure, since the thick wicks (feeds) continuously supply liquid to the monolayer evaporation zone.

Highly Isothermal Heat Sources: This is due to the nature of two-phase heat transfer mechanism that takes place in a constant saturation temperature.

CTE-Matched Structure: aluminum nitride (AlN) can be used as the substrates. AlN has a good coefficient of thermal expansion (CTE) match with transistor material (GaN). Also, other components of the cold plate like Kovar® (a registered trademark owned by CRS Holdings) having a composition by weight of less than to 0.01% C, 0.30% Mn, 0.20% Si, 29% Ni, 17% Co, and balance Fe are CTE-matched with AlN.

Enabling Higher Electrical Power: Applicant's cooling technology is independent of the number of heat sources and allows more heat sources (e.g., transistors) to be mounted on the substrate, leading to an increase in the power of future electronic/power devices compared to the current state-of-the-art.

Dielectric Cold Plate: By using AlN as the substrates and refrigerant as the working fluid, the cold plate is a dielectric enclosure. Both AlN and refrigerant are dielectric materials.

Low Pumping Power: This is due to the nature of active two-phase cooling technology that operates with substantially lower flow rate compared with a single-phase liquid technology for removing a given amount of heat.

Stabilized Two-Phase Flow: Applicant's cooling technology is not channel flow and, therefore, is not prone to flow instabilities that are serious drawbacks in two-phase microchannel heat sinks leading to dry-out/hot spots.

Operating at Different Gravity Orientations: This is due to capillary forces generated by the wick structure. The evaporator wick is fabricated by an appropriate range of powder sizes for generating large enough capillary pressure to overcome summation of the pressure drop across the wick structure and the pressure drop induced by gravity.

In one embodiment, a heat transfer device includes a hollow spacer positioned between opposed substrates, the spacer and inner surfaces of the substrates defining an enclosure, an outer surface of at least one of the substrates adapted to be secured to at least one heat source. The heat transfer devices further includes a non-permeable barrier having an inside surface and an outside surface, the barrier positioned in the enclosure between the substrates. The heat transfer devices further includes a first chamber delimiting a space inside the enclosure, the first chamber defined by the spacer, the substrates, and the outside surface of the barrier, the first chamber in fluid communication with at least one first inlet and at least one first outlet. The heat transfer device further includes a second chamber adjacent to the first chamber, the second chamber delimiting a space inside the enclosure and outside the first chamber, the second chamber defined by the spacer, the substrates, and the inside surface of the barrier, the second chamber in fluid communication with at least one second outlet. The heat transfer device further includes a wick structure secured to the inner surface of at least one substrate, a first portion of the wick structure positioned in the first chamber, and a second portion of the wick structure positioned in the second chamber and interconnecting in passive liquid communication with the first portion.

In a further embodiment, a heat transfer device includes a hollow spacer positioned between opposed substrates, the spacer and inner surfaces of the substrates defining an enclosure, an outer surface of at least one of the substrates adapted to be secured to at least one heat source. The heat transfer device further includes a non-permeable barrier having an inside surface and an outside surface, the barrier positioned in the enclosure between the substrates. The heat transfer device further includes a first chamber delimiting a space inside the enclosure, the first chamber defined by the spacer, the substrates, and the outside surface of the barrier, the first chamber in fluid communication with at least one first inlet and at least one first outlet. The heat transfer device further includes a second chamber adjacent to the first chamber, the second chamber delimiting a space inside the enclosure and outside the first chamber, the second chamber defined by the spacer, the substrates, and the inside surface of the barrier, the second chamber in fluid communication with at least one second inlet. The heat transfer device further includes a wick structure secured to the inner surface of at least one substrate, a first portion of the wick structure positioned in the first chamber, and a second portion of the wick structure positioned in the second chamber and interconnecting in passive liquid communication with the first portion, the at least one first inlet, the at least one second inlet and the at least one first outlet are formed in the spacer.

In another embodiment, a cooling system includes a heat transfer device including a hollow spacer positioned between opposed substrates, the spacer and inner surfaces of the substrates defining an enclosure. The heat transfer device further includes at least one heat source secured to an outer surface of at least one of the substrates. The heat transfer device further includes a non-permeable barrier having an inside surface and an outside surface, the barrier positioned in the enclosure between the substrates. The heat transfer device further includes a first chamber delimiting a space inside the enclosure, the first chamber defined by the spacer, the substrates, and the outside surface of the barrier, the first chamber in fluid communication with at least one first inlet and at least one first outlet. The heat transfer device further includes a second chamber adjacent to the first chamber, the second chamber delimiting a space inside the enclosure and outside the first chamber, the second chamber defined by the spacer, the substrates, and the inside surface of the barrier, the second chamber in fluid communication with at least one second outlet. The heat transfer device further includes a wick structure secured to the inner surface of at least one substrate, a first portion of the wick structure positioned in the first chamber, and a second portion of the wick structure positioned in the second chamber and interconnecting in passive liquid communication with the first portion. The heat transfer device further includes a pump for pumping a liquid through the at least one first inlet inside of the first chamber, any liquid remaining after being pumped through the first chamber and removing heat from the at least one exiting through the first outlet. Heat removed from the at least one heat source through evaporation from the wick structure in the second chamber exits as vapor through the at least one second inlet.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
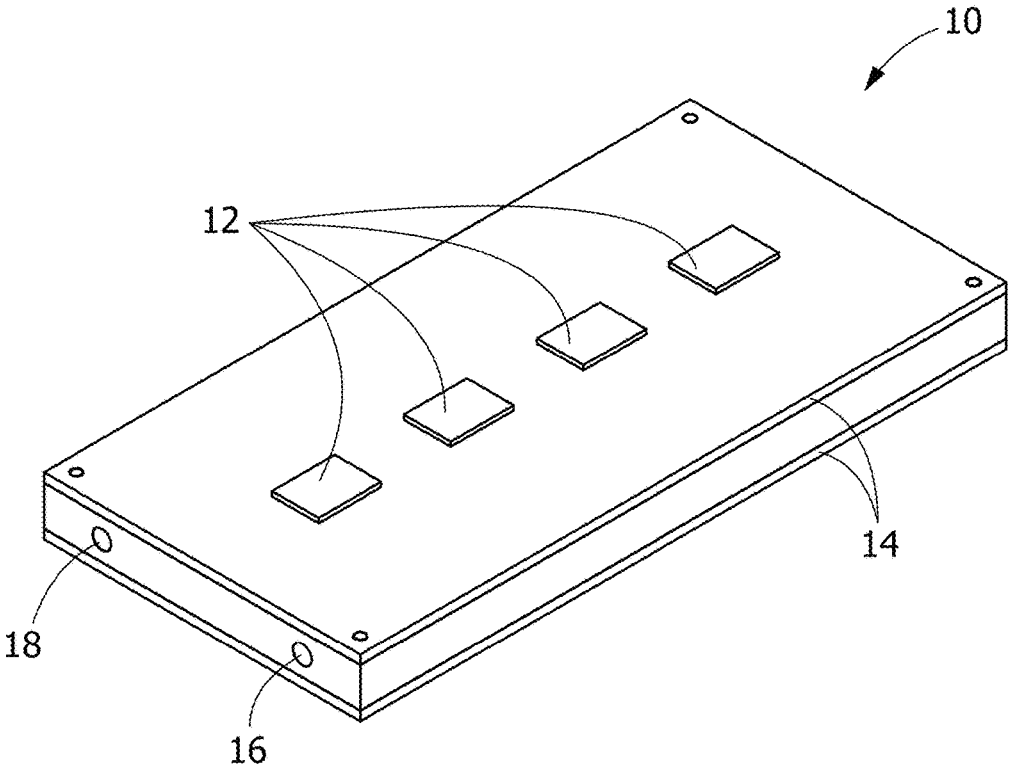
FIG. 1 (PRIOR ART)
FIG. 1 is a perspective view of a known heat transfer device.
Figure 2:
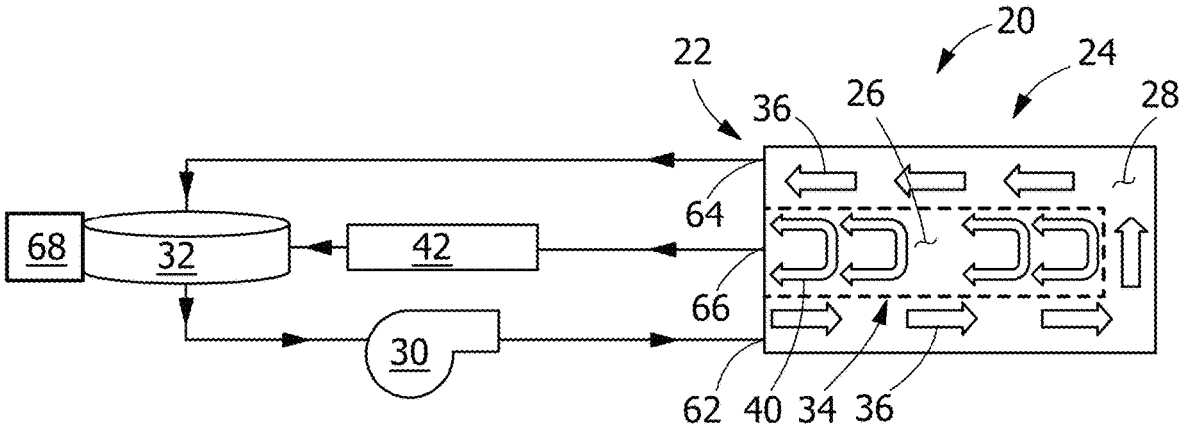
FIG. 2 is a schematic view of an exemplary cooling system.

In one embodiment, a hybrid two-phase cooling system 20 (HTPCS) or cooling system that integrates capillary-driven evaporative cooling with a mechanically pumped two-phase loop 22, is schematically shown in FIG. 2. HTPCS 20 comprises of a heat transfer device 24 such as a cold plate or cold plate evaporator and the mechanically pumped two-phase loop 22. As will be discussed in further detail below, in two-phase loop 22, a pump 30 provides liquid refrigerant 36 to a chamber 28 of heat transfer device 24 to transfer heat from a heat source 38 (FIG. 3A), with any liquid refrigerant remaining (i.e., not being evaporated in chamber 28) exiting chamber 28 and then being provided to a liquid reservoir 32. In a chamber 26 of heat transfer device 24 that is separated from chamber 28 by a non-permeable barrier 34, refrigerant evaporated by heat from heat source 38 (FIG. 3A) becomes vapor refrigerant 40 that is provided to a condenser 42. Condenser 42 removes heat from vapor refrigerant 40 and provides liquid refrigerant 36 to liquid reservoir 32. In one embodiment, heat transfer device 24 is a hermetically sealed and compact enclosure.

Figure 3A:
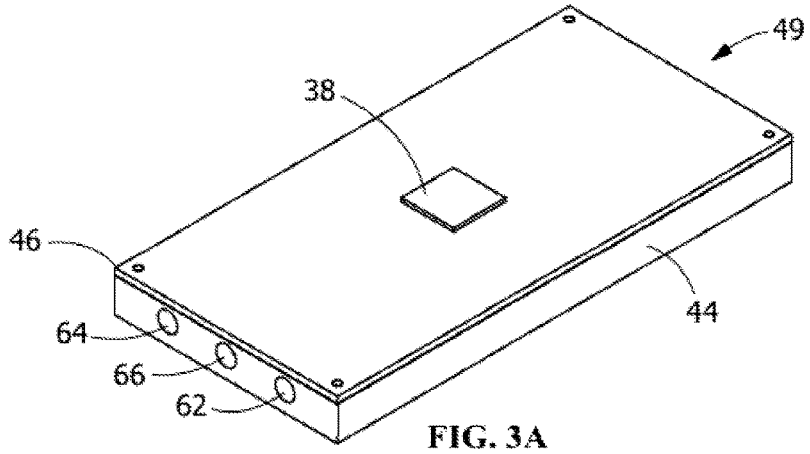
FIG. 3A is a perspective view of an exemplary heat transfer device.
Figure 3B:
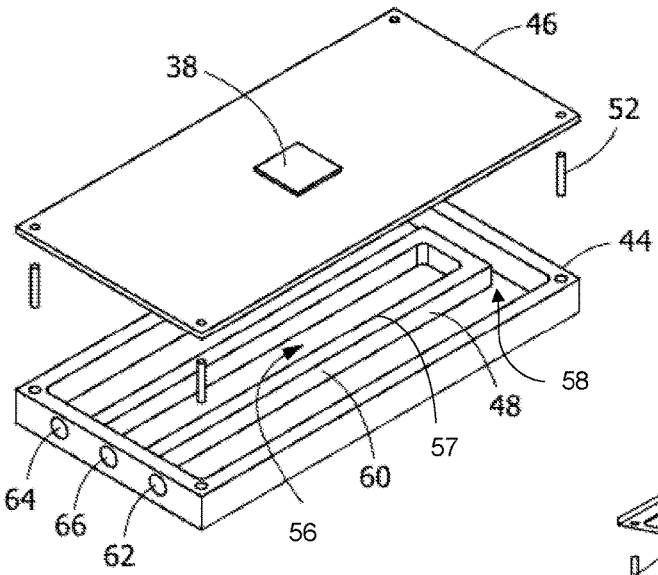
FIG. 3B is an exploded upper perspective view of the heat transfer device of FIG. 3A.
Figure 3C:
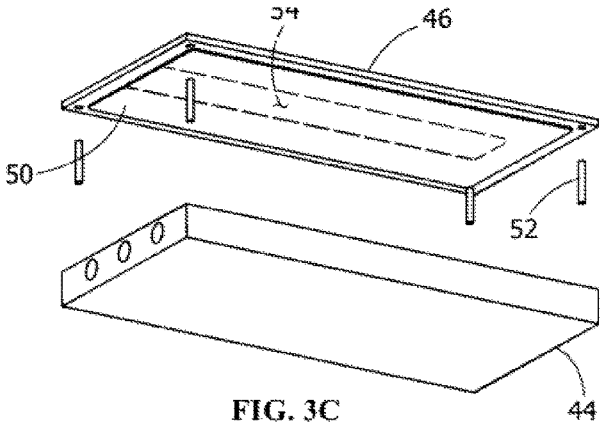
FIG. 3C is an exploded lower perspective view of the heat transfer device of FIG. 3A.
Figure 4A:
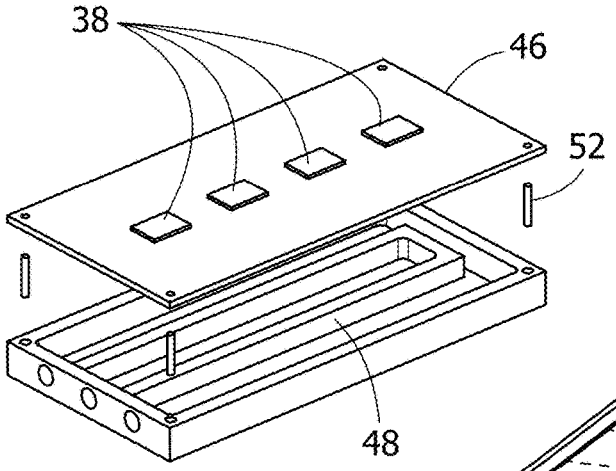
FIG. 4A is an exploded upper perspective view of an exemplary heat transfer device.
Figure 4B:
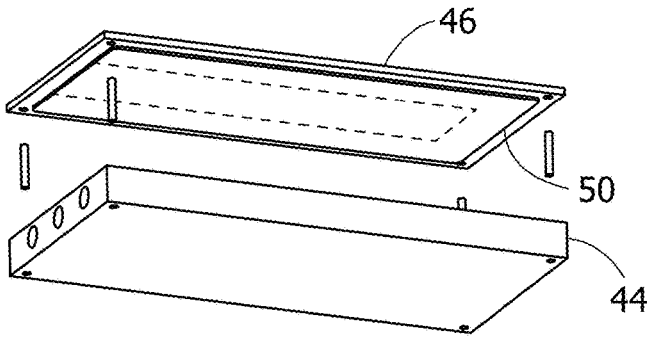
FIG. 4B is an exploded lower perspective view of the heat transfer device of FIG. 4A.

FIGS. 3A-3C collectively show features of heat transfer device 24. Heat transfer device 24 encompasses three major components: a ring or hollow spacer 44, one substrate 46 or opposed substrates 46 (only one substrate shown in FIGS. 3A-3C) and a non-permeable barrier 48 (FIG. 3B) defining an enclosure 49. That is, as shown in FIGS. 3A-3C, substrate 46 and spacer 44 are of integral or one-piece construction, although in one embodiment, a pair of opposed substrates 46 are positioned between and are separate components from spacer 44. Spacer 44 is a support structure such as metal (e.g., copper) to hold substrate 46. Substrate 46 is a thin thermally conductive layer such as a metal layer (e.g., copper) such as a plate including a heat source 38 on one surface (e.g., outer surface) (FIG. 3B) and an evaporator 50 on the opposite surface (e.g., inner surface) (FIG. 3C). In one embodiment evaporator 50 is a wick structure 50 made by sintering metal (e.g., copper) powders on substrate 46. The mechanism of heat removal inside heat transfer device 24 is evaporation from wick structure 50 and the subsequent advection of latent heat as a result of movement by the vapor phase. Wick structures 50 made by sintered particles have been previously identified as one of the most effective techniques to passively reduce the thermal resistance by separating the liquid and vapor phases over the wick structure 50 (evaporator) and maintaining an extremely thin evaporating film on the wick structure 50 (evaporator). Since the evaporation is a two-phase heat transfer mechanism and takes place isothermally, an excellent temperature uniformity is achieved across heat source 38. Heat transfer device 24 can be fabricated by securing with a mechanical fastener, clamping, soldering, brazing or other suitable mechanism or technique to secure substrate(s) 46 to spacer 44.

For purposes herein, the terms "wick," "wick structure," "wick evaporator," "evaporator," and the like may be used interchangeably.

A novel aspect of major significance of the present invention is the vapor-liquid non-permeable barrier 48, which prevents flooding of the evaporator 50. Basically, a flooded evaporator, which results in an increase in the thermal resistance, occurs due to existence of a thick layer of liquid over the evaporator. This condition is avoided in the present invention by using non-permeable barrier 48.

As illustrated in FIG. 3B, an area or region or portion 54 (FIG. 3C; interior of dashed rectangle) of evaporator 50 (FIG. 3C) located directly underneath heat source 38 or on opposed surface(s) of substrate 46, is separated from the remaining portions of evaporator 50 by non-permeable barrier 48. That is, portion 54 (FIG. 3C) is in a chamber 56 delimiting a space inside of enclosure 49 (FIG. 3A), chamber 56 defined by spacer 44, substrate 46 and an inside surface 57 of barrier 48. Portion 54 (FIG. 3C) of chamber 56 is adjacent to but separated from a chamber 58 of enclosure 49 (FIG. 3A) by barrier 48, chamber 58 delimiting a space inside of enclosure 49 (FIG. 3A) and outside of chamber 56, chamber 58 defined by spacer 44, substrate 46 and an outside surface 60 of barrier 48. In one embodiment, the thickness of evaporator 50 may vary, such as being thinner or thicker along barrier 48 so as to provide clearance for barrier 48 upon assembly of heat transfer device 24. Upon assembly, such as with mechanical fasteners 52 to secure substrate 46 to spacer 44, barrier 48 forms a fluid tight joint with evaporator 50 to prevent the flow of liquid refrigerant 36 (FIG. 2) and vapor refrigerant 40 (FIG. 2) therebetween. Pump 30 (FIG. 2) continuously supplies liquid refrigerant 36 to chamber 58 of heat transfer device 24 via an inlet 62. In one embodiment, inlet 62 is adapted to receive only liquid refrigerant. A portion of the liquid is transported laterally through wick structure 50 (FIG. 3C) of chamber 58 passively by capillary action or passive liquid communication to chamber 56 for evaporation, and the remaining liquid flowing through chamber 58 exits chamber 58 via outlet 64. Thermal energy generated by heat source 38 is conducted via substrate 46 and is the latent heat source for evaporation. This allows the liquid in wick structure 50 (FIG. 3C) in portion 54 (FIG. 3C) of chamber 56 (FIG. 3B) to change to the vapor phase within non-permeable barrier 48. Vapor pressure then drives this vapor to condenser 42 (FIG. 2) via outlet 66. The refrigerant flowing from chamber 58 via outlet 64 may be a two-phase mixture if vapor is generated due to evaporation/boiling of liquid on the wick structure 50 (FIG. 3C) outside non-permeable barrier 48.

Moreover, as illustrated in FIGS. 3A-3C, in addition to preventing mixing of the refrigerant vapor and liquid phases between chambers 56, 58 and, in turn, preventing flooding of the evaporator 50, non-permeable barrier 48 allows the refrigerant vapor and refrigerant liquid flow to exit heat transfer device 24 from separate outlets (i.e., respective outlet 66 and outlet 64). Therefore, evaporator 50 in chamber 56 is completely separated from refrigerant liquid in chamber 58 throughout the entire cooling process, which is crucial to avoid a flooded evaporator wick. Thus, the interior space of heat transfer device 24 bounded by non-permeable barrier 48 between substrates 46 (chamber 56) is only vapor resulting from evaporation, and the space of enclosure 49 of heat transfer device 24 exterior of chamber 56 bounded between non-permeable barrier 48 and spacer 44 between substrates 46 (chamber 58) is a two-phase mixture.

As one of the benefits of the present invention as shown in FIGS. 3A-3C, heat source 38 is cooled only by its corresponding evaporator 50 inside the barrier 48 that is directly located on the opposite side of the substrate 46. This means that heat transfer device 24 can operate independently from the number of heat sources 38, as long as the corresponding evaporator 50 of an individual heat source 38 is located within or bounded by the interior side of the non-permeable barrier 48, as illustrated in FIGS. 4A-4B and 8A-8C.

As shown in FIG. 3B, the gap between non-permeable barrier 48 and the spacer 44 allows the liquid refrigerant flow received from inlet 62 to turn inside chamber 58 of heat transfer device 24 and exit heat transfer device 24 from the same side of spacer 44 via outlet 64. As illustrated in FIG. 2, the liquid refrigerant flow received from inlet 62 returns directly to liquid reservoir 32 via outlet 64. Liquid reservoir 32 ensures that the inlet flow to pump 30 is single-phase liquid to avoid cavitation in the pump 30. If heat load increases, the total vapor flow will increase, primarily through outlet 66. The flow through outlet 64 may or may not be two phase flow. Therefore, to ensure that the inlet flow to pump 30 is single-phase liquid, reservoir 32 is designed like a condenser, such that a heat exchanger 68 is connected to reservoir 32 to further cool down the outlet flow from reservoir 32 (inlet flow to pump 30). After reservoir 32, the subcooled liquid is pumped into heat transfer device 24 via inlet 62, and the loop is complete. The temperature of the inlet liquid is adjusted by the temperature of condenser 42. One of the advantages of a pumped two-phase loop compared with pumped single-phase liquid loop is a significantly lower flow rate used in a two-phase loop to remove a given amount of heat. This is a result of the much higher thermal energy transport capacity of latent heat compared to sensible heat. Such a low flow rate results in a significantly lower pressure drop and the required amount of pumping power in a pumped two-phase cooling loop is significantly reduced compared with a single-phase liquid-cooled loop. As a result, the HTPCS in the present invention operates with very low pressure drop and pumping power.

Figure 5:
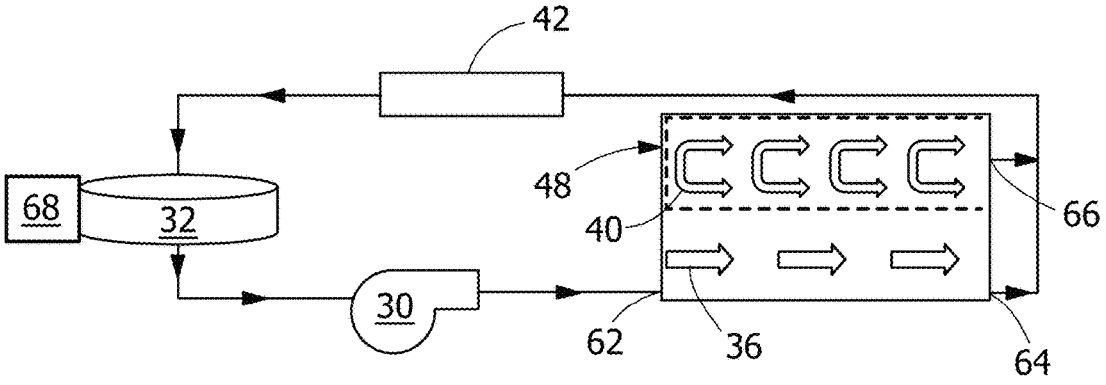
FIG. 5 is a schematic view of an exemplary cooling system.

Although inlet 62 and outlet 64 manifolds are located on the same side and on the side wall (e.g., spacer 44) of heat transfer device 24 in FIGS. 2-4, inlets 62 and outlets 64 can be located anywhere inside heat transfer device 24, depending on the design requirements. In other words, side-feeding that serves to supply heat transfer device 24 with refrigerant liquid from the side wall of heat transfer device 24 (shown in FIGS. 2-4) is not necessary for proper operation of the device. For example, FIG. 5 illustrates another embodiment of the proposed cooling solution in this invention in which outlets 64, 66 are located on the opposite side of inlet 62. In this case, non-permeable barrier 48 (shown as dashed lines) is attached to the side wall of heat transfer device 24. Other configurations such as implementing the inlets and/or outlets on the substrates, instead of side walls, are easily possible and contemplated by the present invention. In fact, as long as the vapor and liquid are separated from each other by a non-permeable barrier, the proposed heat transfer device can be fabricated in a variety of designs with different locations for inlets and outlets on the heat transfer device.

Another advantage of the proposed cooling solution is removing the heat from multiple heat sources 38 that are located on both of the opposed substrates 46. In this case, spacer 44 is fabricated as a hollow structure to support two substrates 46 with multiple heat sources 38, as illustrated in FIGS. 6A and 6B.

Figure 6A:
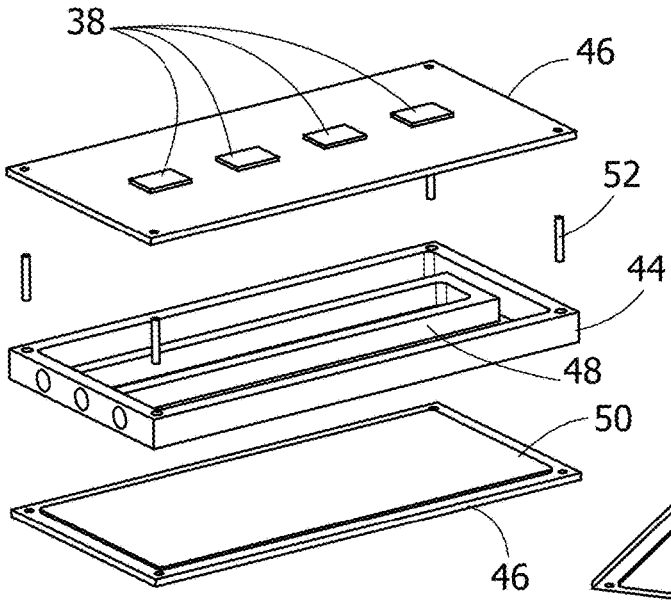
FIG. 6A is an exploded upper perspective view of an exemplary heat transfer device.
Figure 6B:
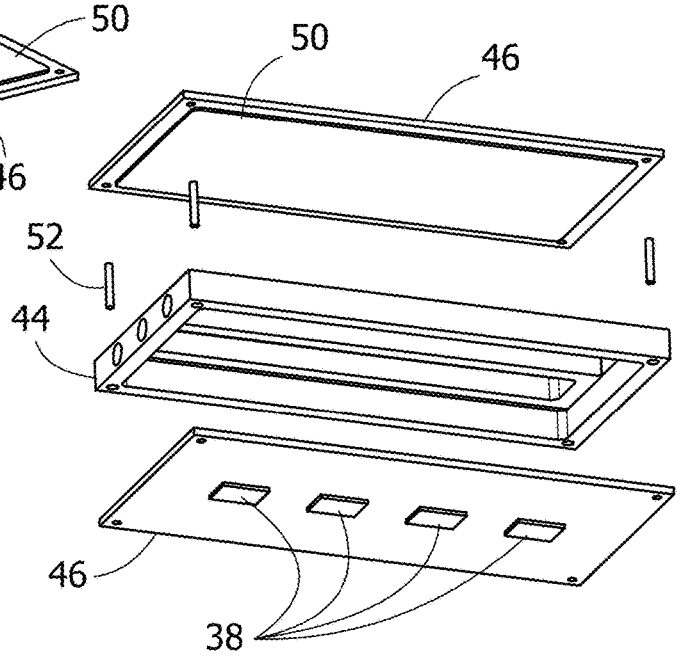
FIG. 6B is an exploded lower perspective view of the heat transfer device of FIG. 6A.
Figure 7:
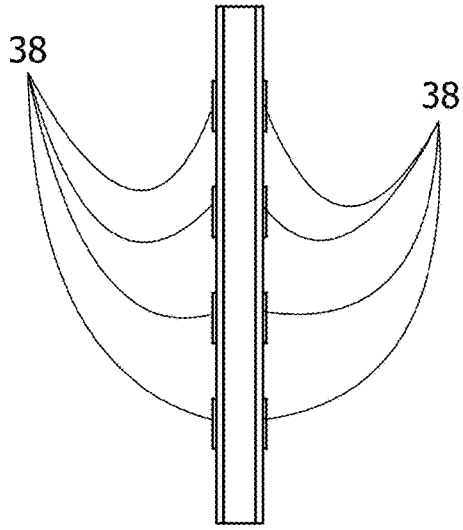
FIG. 7 is a side view of the heat transfer device of FIGS. 6A and 6B.

In addition, the heat transfer device operates at different gravity orientations such as the 90 degree rotation as shown in FIG. 7 relative to the orientation of FIGS. 6A and 6B. In fact, as long as the capillary forces generated by the wick structure overcome the pressure drops due to both the liquid transport across the wick and gravity, liquid is wicked through the wick structure. Since capillary forces depend on the size of powders for fabrication of wick structure, selecting an appropriate range of powder sizes guarantees sufficient capillary forces and, in turn, operation of the heat transfer device at different gravity orientations.

Also, in some applications like the RF power devices previously discussed, the cooling system must be dielectric to prevent electricity conductance between the transistors. In one embodiment, heat transfer device in this invention can be fabricated as a dielectric, CTE-matched, and low CTE enclosure. In this case, the heat transfer device is fabricated by using direct bounded copper (DBC) AlN substrate(s) and a Kovar® spacer having a composition by weight of less than to 0.01% C, 0.30% Mn, 0.20% Si, 29% Ni, 17% Co, and balance Fe, which are CTE-matched and have a low CTE of between 4 ppm/K and 10 ppm/K, respectively. Also, the working fluid would be a refrigerant that has a dielectric strength, instead of water. Compared with printed circuit boards (PCBs), DBC ceramic substrates exhibit four times lower thermal resistance and significant mitigation of parasitic inductances. As another merit of using AlN substrates, this material has a relatively high thermal conductivity (150-200 W/m·K) compared with the low thermal conductivity of PCB materials (typically FR4<1 W/m·K). Therefore, AlN substrates are able to remove significantly larger amount of heat from heat generating components such as transistors compared with PCBs, at a given temperature difference.

Due to the high thermal conductivity of copper, copper particles may be used for developing a wick structure. Also, copper is compatible with a variety of working fluids, such as refrigerants and water. However, copper particles must be sintered on a copper surface. The DBC layers allow for the sintering the wick structures on the evaporators.

In addition, the DBC layers allow direct soldering of GaN transistors on the external surfaces of the substrates, which eliminates the need of a thermal interface that causes an extra thermal resistance.

Figure 8A:
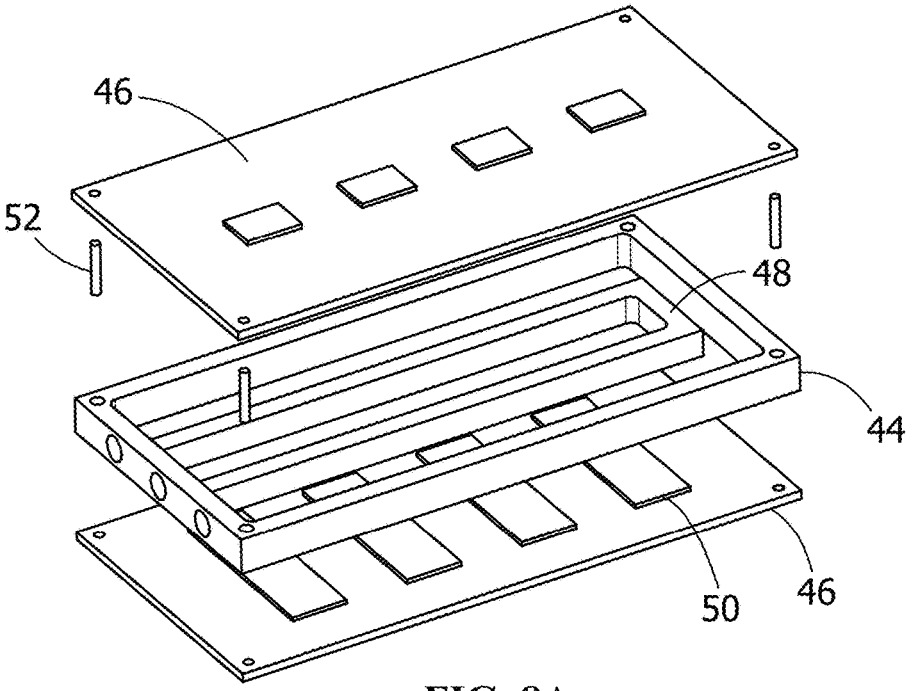
FIG. 8A is an exploded view of an exemplary heat transfer device.
Figure 8B:
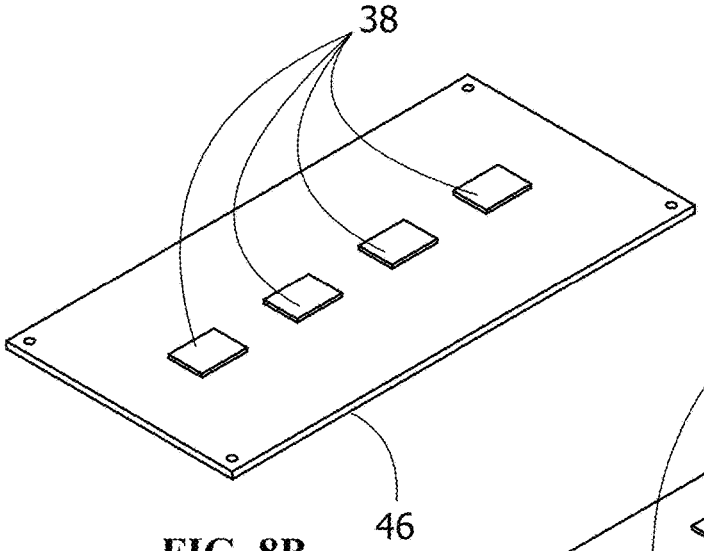
FIG. 8B is an upper perspective view of one substrate of the heat transfer device of FIG. 8A.
Figure 8C:
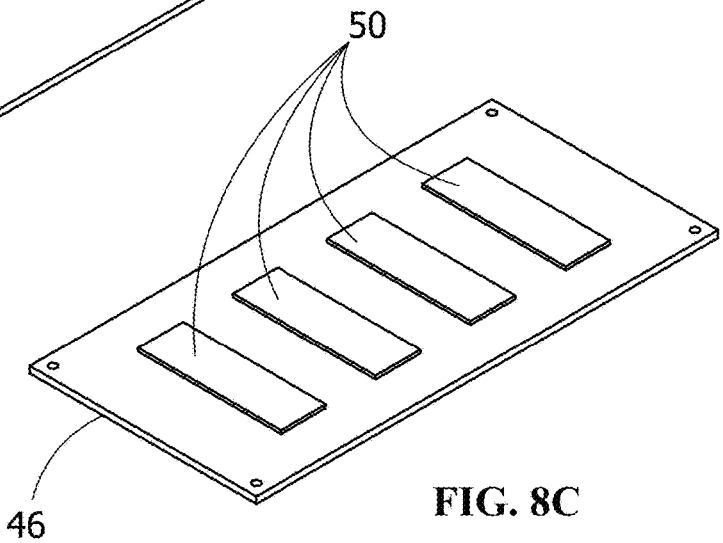
FIG. 8C is an upper perspective view of the other substrate of the heat transfer device of FIG. 8A.

Effective materials in an efficient thermal management solution are those with high thermal conductivity to enhance the heat dissipation, and low coefficient of thermal expansion (CTE) in order to minimize thermal stress. In addition, the CTEs of the materials adjacent to each other must be close to each other (called CTE-match) in order to avoid a CTE mismatch that leads to the device failure. Exemplary CTE materials include: $Al_2O_3$ (aluminium oxide or alumina) having 6.8 ppm/K with DBC being 5% to 30% higher (dependent on copper thickness), HPS ($ZrO_2$ doped) having 7.1 ppm/K with DBC being 5% to 60% higher (dependent on copper thickness), and AlN (aluminium nitride) having 4.7 ppm/K with DBC being 5% to 30% higher (dependent on copper thickness), such as employed for substrates manufactured by Rogers Corporation. DBC AlN is CTE-matched with GaN. To fabricate the dielectric and CTE-matched heat transfer device, the copper layers are etched on both sides of the AlN substrates at the locations of transistors and evaporators, as illustrated in FIGS. 8A-8C. Other suitable materials having a CTE close to the material of the electronics or heat source (e.g., transistor), such as $Si_3N_4$ (silicon nitride) may also be used. In other embodiments, other techniques such as active metal brazing (AMB) may be used to attach the copper layers. In other embodiments, in addition to copper, other metals such as nickel and aluminum may be used.

Since the evaporator thermal resistance is dominant in the overall thermal resistance of the cooling system, reducing the evaporator thermal resistance is the primary focus in designing an efficient evaporator. However, due to the trend of the rapidly increasing power of electronic devices, further reducing the evaporator thermal resistance is essential; otherwise the large thermal resistance leads to an overheated device and ultimately device failure. On the other hand, a high heat transfer limit (Critical Heat Flux (CHF)) is another important parameter that must be considered to designing an efficient wick structure because the rapid increase in the power density of electronic devices results in high heat fluxes, such as greater than 200 W/cm$^2$ encountered in some applications. Although thin evaporator wicks with high effective thermal conductivity are desired to reduce the evaporator thermal resistance, they suffer from low CHF limits due to their large liquid hydraulic resistances. In fact, the capillary pressure generated by the wick must be greater than the liquid pressure drop through the wick ($\Delta P_{wick}$).

Figure 9:
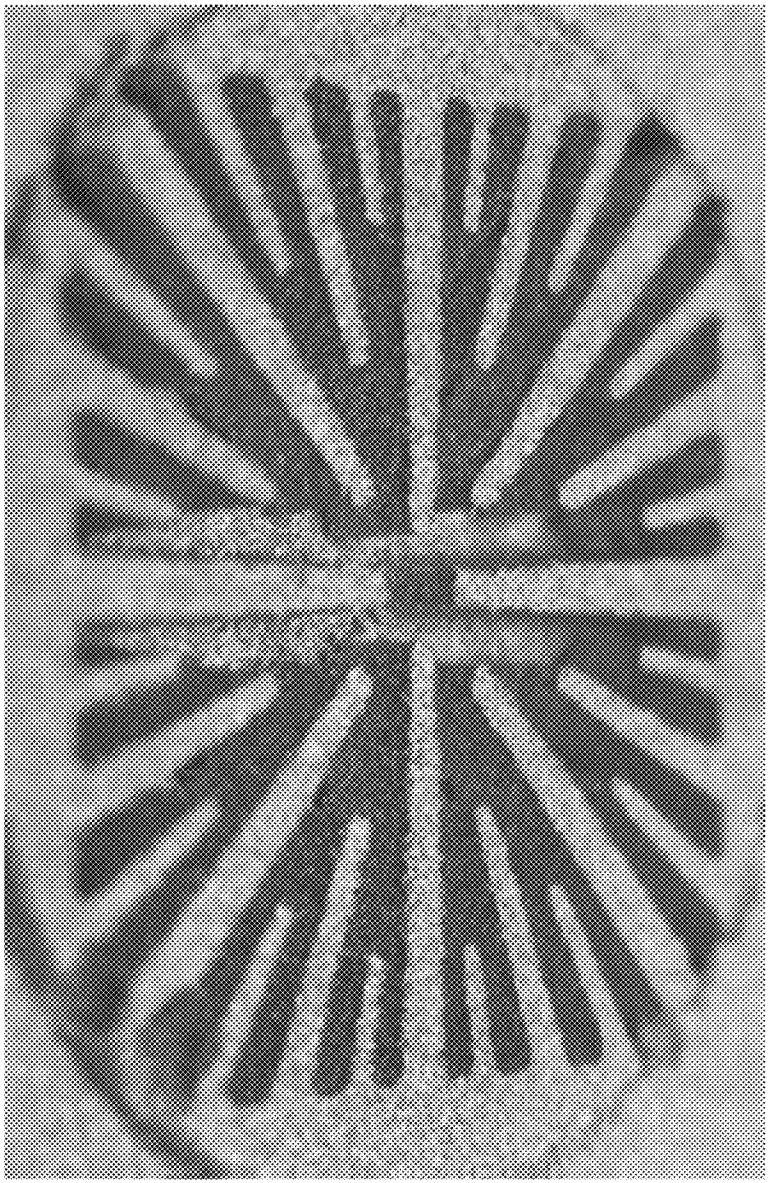
FIG. 9 is an upper perspective view of an exemplary wick structure.

Otherwise, an insufficient amount of liquid is provided to the wick, which results in a dry-out and ultimately device failure. To increase the CHF limit, $\Delta P_{wick}$ must be decreased to allow for delivery of liquid at high flow rates to the evaporation sites. This is achieved by a wick or wick structure, sometimes referred to as a "thick wick" or "thick wick structure". In one embodiment, thick wick structure 72 (FIG. 9) has a thickness between 4 particle diameters (0.004 mm) and 1 cm. However, these two conflicting considerations present significant challenges in designing effective evaporator wick structures for handling high heat fluxes such that, while a thick wick is favorable for increasing CHF, a thin wick or thin wick structure is favorable for low evaporator thermal resistance. In one embodiment, thin wick structure 74 (FIG. 9) has a thickness between a monolayer or one particle diameter (0.001 mm) to 0.8 cm. In one embodiment, particles are between 0.001 mm and 0.3 mm. As a result, to achieve a high CHF and a low thermal resistance simultaneously, a wick structure must be optimized such that the ideal wick structure should have separate features for both liquid delivery and evaporation heat transfer. To meet this goal, as shown in FIG. 9, Applicant leverages the concept of a hybrid wick structure 70 including a feed wick structure such as a thin monolayer wick structure 74 and a thick wick structure 72 for substantially reducing the thermal resistance and increasing CHF, simultaneously. Using this wick design, liquid will be driven through individual thick feed wick structures 72 and distributed to adjacent thin (monolayer) wick structure 74 sections for evaporation with minimum thermal resistance.

In one embodiment, the wick structure is at least one of sintered particles or powder, metal felt, and a screen.

In one embodiment, a variant of the previously described invention utilizes Additive Manufacturing (AM) techniques using ceramics or other suitable materials. That is, such techniques permit the manufacture or fabrication of the heat transfer device or cold plate as a single piece or single unit or one-piece or one-piece construction with the porous wick or wick structure or evaporator and solid envelope or enclosure printed in a single run. This technique allows for a more compact design, more efficient liquid and vapor routing options, and a more reliable hermetic seal compared to brazing the chamber together from separate components.

A primary driver for this variant is the desire to remove the brazing stage of the previous design. Brazing that design involves joining a Direct Bond Copper (DBC)/Aluminum Nitride substrate to a copper-plated Kovar ring. The various materials involved in this process complicate this fabrication stage. By switching to a single material, such as a ceramic material or other suitable material, the dielectric properties can be maintained while greatly simplifying fabrication.

Figure 10:
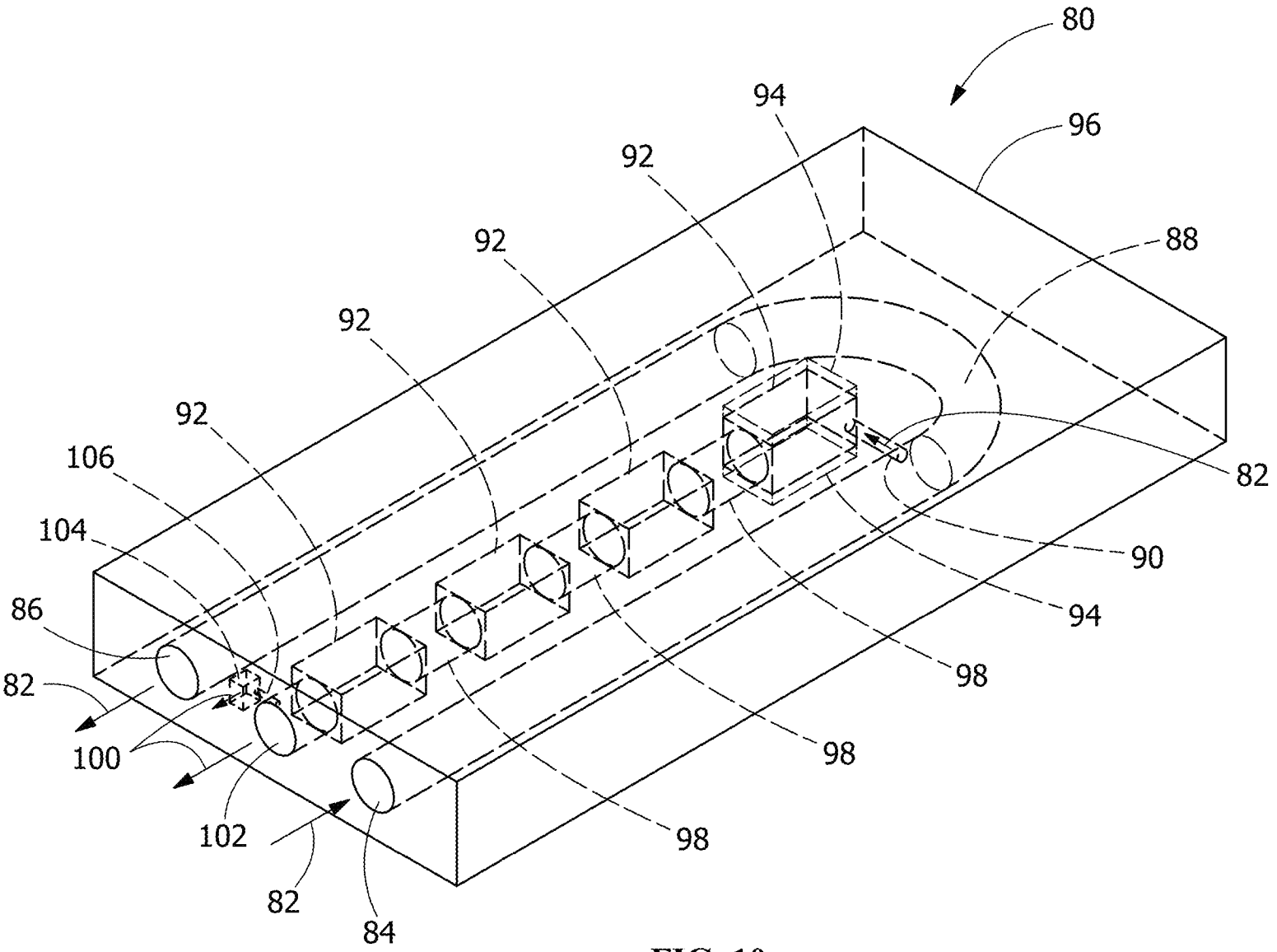
FIG. 10 is a perspective view of an exemplary heat transfer device.

Conventional manufacturing also limits the design of the wick structures and flow channels. By switching to AM, both of these features can be customized in intricate ways to minimize heat transfer device or cold plate size, fluid pressure drop, thermal resistance, and optimize liquid delivery through the evaporator or wick. An exemplary AM cold plate or heat transfer device 80 is shown in FIG. 10. A liquid 82, which includes a liquid/vapor mixture, enters through a coolant inlet 84 and exits through a coolant outlet 86 via a coolant flow channel 88. As the flow direction of liquid 82 does not matter through coolant flow channel 88, the role or orientation of coolant inlet 84 and coolant outlet 86 could be reversed. Liquid 82 is drawn through at least one porous portion 90 of the device extending between coolant flow channel 88 and an evaporation chamber 92. In one embodiment, one or more porous portions 90 extends between coolant flow channel 88 and each evaporation chamber 92. The porosity of each porous portion 90 is designed to maximize liquid flow to the evaporation surface(s) of evaporation chamber 92. In one embodiment, as shown, the top and bottom of evaporation chamber 92 each includes a thin porous layer 94 that is designed to maximize evaporative heat transfer. In one embodiment, one or more portions (including partial or full portions) of one or more surfaces of evaporation chamber 92 can include a corresponding porous layer 94. In one embodiment, the porosity of at least one of porous portions(s) 90 and porous layer 94 may be uniform. In one embodiment, the porosity of at least one of porous portions(s) 90 and porous layer 94 may vary. In one embodiment, the porosity of porous portion(s) 90 and porous layer(s) 94 may be the same. In one embodiment, at least a portion of the porosity of porous portion(s) 90 and porous layer(s) 94 may be different from one another. In one embodiment, the heat sources (not shown) may be located on the outside of a body 96 of cold plate or heat transfer device 80 and in close proximity to a corresponding one or more evaporation chamber(s) 92, such as in a similar arrangement as previously discussed. Each evaporation chamber 92 is connected by vapor flow channels 98, such as by a serial connection between adjacent evaporation chambers 92 that allows vapor 100 to exit through a vapor outlet 102.

It is to be understood that the body of the cold plate or heat transfer device incorporates any of the features of the previously discussed cold plate or heat transfer device, including, but not limited to the substrate(s), non-permeable barrier, evaporator or wick or wick structure, chambers, inlets, and outlets. As a result, any combination of the features of the heat transfer device may be of one-piece construction.

Note that the exemplary AM design shown by FIG. 10 was selected because it most closely matches the previous conventionally machined and brazed design disclosed herein. However, as appreciated by those having ordinary skill in the art, when using AM techniques, liquid, vapor or a liquid/vapor mixture could be delivered to one or more different locations simply by printing a porous structure 104 rather than solid structure within the body of the cold plate or heat transfer device and providing an open passageway 106 to vapor outlet channel 102. As a result, this type of approach is highly customizable to a variety of heat source locations.

It is to be understood that the various descriptions of the embodiments disclosed herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

In the present disclosure, other than where otherwise indicated, all numbers expressing quantities or characteristics are to be understood as being prefaced and modified in all instances by the term "about." Accordingly, unless indicated to the contrary, any numerical parameters set forth in the following description may vary depending on the desired properties one seeks to obtain in the embodiments according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicant reserves the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. .sctn.112, first paragraph, and 35 U.S.C. .sctn.132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material, in whole or in part, that is said to be incorporated by reference herein, is incorporated herein in its entirety, but only to the extent that the incorporated material does not conflict with existing definitions, statements, or other disclosure material expressly set forth in this disclosure. As such, and to the extent necessary, the express disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A heat transfer device comprising:

a hollow spacer positioned between opposed substrates, the spacer and inner surfaces of the substrates defining an enclosure, an outer surface of at least one of the substrates adapted to be secured to at least one heat source;

a non-permeable barrier having an inside surface and an outside surface, the barrier positioned in the enclosure between the substrates;

a first chamber delimiting a space inside the enclosure, the first chamber defined by the spacer, the substrates, and the outside surface of the barrier, the first chamber in fluid communication with at least one first inlet and at least one first outlet;

a second chamber adjacent to the first chamber, the second chamber delimiting a space inside the enclosure and outside the first chamber, the second chamber defined by the spacer, the substrates, and the inside surface of the barrier, the second chamber in fluid communication with at least one second outlet; and a wick structure secured to the inner surface of at least one substrate, a first portion of the wick structure positioned in the first chamber, and a second portion of the wick structure positioned in the second chamber and interconnecting in passive liquid communication with the first portion.

2. The heat transfer device of claim 1, wherein the at least one first inlet, the at least one first outlet and the at least one second outlet are formed in the spacer.

3. The heat transfer device of claim 1, wherein the wick structure is composed of particles that are sintered together.

4. The heat transfer device of claim 3, wherein the particles are between 0.001 mm and 0.3 mm.

5. The heat transfer device of claim 1, wherein the wick structure is at least one of sintered powder, metal felt, and a screen.

6. The heat transfer device of claim 1, wherein the wick structure is a hybrid wick structure.

7. The heat transfer device of claim 6, wherein the hybrid wick structure comprises a first wick structure having a thickness between 0.004 mm and 1 cm and a second wick structure having a thickness between 0.001 mm and 0.8 cm.

8. The heat transfer device of claim 1, wherein the enclosure is a dielectric enclosure.

9. The heat transfer device of claim 1, wherein the enclosure is composed materials having a coefficient of thermal expansion of between 4 ppm/K and 10 ppm/K.

10. The heat transfer device of claim 1, wherein the at least one inlet is adapted to receive only liquid refrigerant.

11. The heat transfer device of claim 1, wherein the spacer has a composition by weight of less than to 0.01% C, 0.30% Mn, 0.20% Si, 29% Ni, 17% Co, and balance Fe.

12. The heat transfer device of claim 1, wherein the substrates are composed of aluminum nitride.

13. The heat transfer device of claim 1, wherein passive liquid communication between the first portion and the second portion of the wick structure is achieved by capillary action.

14. A heat transfer device comprising:

a hollow spacer positioned between opposed substrates, the spacer and inner surfaces of the substrates defining an enclosure, an outer surface of at least one of the substrates adapted to be secured to at least one heat source;

a non-permeable barrier having an inside surface and an outside surface, the barrier positioned in the enclosure between the substrates;

a first chamber delimiting a space inside the enclosure, the first chamber defined by the spacer, the substrates, and the outside surface of the barrier, the first chamber in fluid communication with at least one first inlet and at least one first outlet;

a second chamber adjacent to the first chamber, the second chamber delimiting a space inside the enclosure and outside the first chamber, the second chamber defined by the spacer, the substrates, and the inside surface of the barrier, the second chamber in fluid communication with at least one second inlet; and a wick structure secured to the inner surface of at least one substrate, a first portion of the wick structure positioned in the first chamber, and a second portion of the wick structure positioned in the second chamber and interconnecting in passive liquid communication with the first portion;

wherein the at least one first inlet, the at least one second inlet and the at least one first outlet are formed in the spacer.

15. The heat transfer device of claim 14, wherein the wick structure composed of particles that are sintered together.

16. The heat transfer device of claim 15, wherein the particles are between 0.001 mm and 0.3 mm.

17. The heat transfer device of claim 14, wherein the wick structure is a hybrid wick structure.

18. The heat transfer device of claim 14, wherein the spacer has a composition by weight of less than to 0.01% C, 0.30% Mn, 0.20% Si, 29% Ni, 17% Co, and balance Fe.

19. A cooling system comprising:

a heat transfer device comprising:

a hollow spacer positioned between opposed substrates, the spacer and inner surfaces of the substrates defining an enclosure;

at least one heat source secured to an outer surface of at least one of the substrates;

a non-permeable barrier having an inside surface and an outside surface, the barrier positioned in the enclosure between the substrates;

a first chamber delimiting a space inside the enclosure, the first chamber defined by the spacer, the substrates, and the outside surface of the barrier, the first chamber in fluid communication with at least one first inlet and at least one first outlet;

a second chamber adjacent to the first chamber, the second chamber delimiting a space inside the enclosure and outside the first chamber, the second chamber defined by the spacer, the substrates, and the inside surface of the barrier, the second chamber in fluid communication with at least one second outlet; and a wick structure secured to the inner surface of at least one substrate, a first portion of the wick structure positioned in the first chamber, and a second portion of the wick structure positioned in the second chamber and interconnecting in passive liquid communication with the first portion; and a pump for pumping a liquid through the at least one first inlet inside of the first chamber, any liquid remaining after being pumped through the first chamber and removing heat from the at least one exiting through the first outlet;

wherein heat removed from the at least one heat source through evaporation from the wick structure in the second chamber exits as vapor through the at least one second inlet.

20. The cooling system of claim 19, wherein the liquid is pumped in a two-phase cooling loop.

21. The heat transfer device of claim 1, wherein the wick structure and the non-permeable barrier are of one-piece construction.

22. The heat transfer device of claim 1, wherein the wick structure, the non-permeable barrier, the first chamber, the second chamber, the at least one first inlet, the at least one first outlet, and the at least one second outlet are of one-piece construction.

* * * * *